US009538832B2

(12) United States Patent
Chou et al.

(10) Patent No.: US 9,538,832 B2
(45) Date of Patent: Jan. 10, 2017

(54) BACK CARRIER FRAME

(71) Applicant: Yi-Shan Chou, Kaohsiung (TW)

(72) Inventors: Yi-Shan Chou, Kaohsiung (TW); Shao-Jung Chou, Kaohsiung (TW); Wen-Ling Chou, Kaohsiung (TW)

(73) Assignee: Yi-Shan Chou, Kaohsiung (TW)

( * ) Notice: Subject to any disclaimer, the term of this patent is extended or adjusted under 35 U.S.C. 154(b) by 0 days.

(21) Appl. No.: 14/736,316

(22) Filed: Jun. 11, 2015

(65) Prior Publication Data

US 2016/0360866 A1 Dec. 15, 2016

(51) Int. Cl.

| | |
|---|---|
| ***A45F 3/00*** | (2006.01) |
| ***A45F 3/04*** | (2006.01) |
| ***A45F 3/14*** | (2006.01) |
| ***A45F 3/10*** | (2006.01) |

(52) U.S. Cl.

CPC ..... *A45F 3/10* (2013.01)

(58) Field of Classification Search

CPC ..... A45F 3/10; A45F 3/00; A45F 3/04; A45F 3/14; A45F 2003/146

See application file for complete search history.

(56) References Cited

U.S. PATENT DOCUMENTS 903,682 A * 11/1908 Cumpston ..... A45B 11/02 135/98
1,704,407 A * 3/1929 Rice ..... A45B 11/02 135/16
2,223,253 A * 11/1940 Hamilton ..... A45B 11/02 135/98
2,380,437 A * 7/1945 Homrighausen ..... A61H 3/00 297/118
2,629,429 A * 2/1953 Baumfeld ..... A47C 9/105 297/118
3,120,332 A * 2/1964 White ..... A45B 11/02 224/189
3,690,525 A * 9/1972 Koons ..... B60N 2/286 224/155
3,985,387 A * 10/1976 Rischar ..... A47C 4/52 297/16.1
4,537,339 A * 8/1985 Pearson ..... A45B 11/02 224/186

(Continued)

FOREIGN PATENT DOCUMENTS

TW M484326 U 8/2014

*Primary Examiner* — Brian D Nash

(74) *Attorney, Agent, or Firm* — Alan D. Kamrath; Kamrath IP Lawfirm, P.A.

(57) ABSTRACT

A back carrier frame includes a base. The base includes a body and a retaining device. The body includes a plurality of first pivotal portions. The retaining device is mounted to the body. A fixing seat includes an annular groove and a fixing portion. The retaining device is engaged in the annular groove to retain the fixing seat in place. The fixing portion extends out of the body. A support device includes at least three main supports. Each of the at least three main supports includes a second pivotal portion and a connection portion. The second pivotal portion of each of the at least three main supports is pivotably connected to one of the first pivotal portions. Each of two straps has two ends respectively coupled to two of the connection portions of the at least three main supports.

15 Claims, 10 Drawing Sheets

(56) References Cited

U.S. PATENT DOCUMENTS

| | | | | | |
|---|---|---|---|---|---|
| 4,582,165 | A * | 4/1986 | Latini | A01M 31/02 | 108/152 |
| 5,263,837 | A * | 11/1993 | Dompe | A45B 11/02 | 224/190 |
| 5,332,283 | A * | 7/1994 | Gray | A47C 4/52 | 297/129 |
| 5,409,291 | A * | 4/1995 | Lamb | A01K 97/10 | 224/155 |
| 5,513,786 | A * | 5/1996 | Drane | A45B 11/02 | 135/34.2 |
| 5,887,771 | A * | 3/1999 | Perry | A45B 11/02 | 224/190 |
| 6,024,464 | A * | 2/2000 | De Vera | A45B 3/04 | 224/190 |
| 6,186,593 | B1 * | 2/2001 | Garneau | A47B 83/008 | 248/464 |
| 6,308,722 | B1 * | 10/2001 | Christie | A45B 11/00 | 135/16 |
| 6,843,527 | B2 * | 1/2005 | Nelson | A47C 4/40 | 297/129 |
| 8,678,019 | B2 * | 3/2014 | Christie | A45F 4/02 | 135/16 |
| 2011/0062197 | A1 * | 3/2011 | Cottrell | A45B 11/02 | 224/188 |
| 2016/0095406 | A1 * | 4/2016 | Bowerman | A44B 11/04 | 24/163 R |

* cited by examiner

BACK CARRIER FRAME

BACKGROUND OF THE INVENTION

1. Field of the Invention

The present invention relates to a back carrier frame and, more particularly, to a back carrier frame for fixing an object, permitting a user to carry the object on his or her back.

2. Description of the Related Art

When a user is doing outdoor activities, the user often has to carry a plurality of objects, such as water bottles, an umbrella, or any kind of luggage, for various needs. When the user carrying the objects intends to move between two places on foot, what is on the user's mind would be how to move while carrying the objects instead of planning the schedule.

A moving user carrying objects generally holds the objects by hands or using a carriage device to receive and transport the objects. For example, the objects can be placed in a push cart or baggage, assisting the user in transporting the objects.

However, no matter if the user directly holds the objects by hands or using the carrier device to transport the objects, the user has to use at least one hand to hold the objects or to control movement of the carriage device, such that the hand of the user gets tired easily. Furthermore, the user whose both hands are busy will feel great inconvenience if the user is in a situation requiring both hands. Furthermore, the conventional carrier device generally receives the objects which can be stacked. In a case that the user wants to fix an object beside him or her, the conventional carriage device cannot fulfill the need of the user, providing poor use flexibility. Furthermore, the conventional carriage device is bulky, occupies a large space, and cannot be folded. It would be a burden to the user if the user has to carry the bulky carriage device that is still not in use. Namely, the carriage device is inconvenient to carry. An example of the carrier device is disclosed in Taiwan Utility Model No. M484326 entitled "WEARING EQUIPMENT FOR FIXING UMBRELLA".

Thus, a need exists for a novel back carrier frame for fixing the problems of inconvenience of carrying objects, poor use flexibility, and inconvenience of carrying the carriage device.

SUMMARY OF THE INVENTION

An objective of the present invention is to provide a back carrier frame permitting a user to easily carry an object, increasing the convenience of carrying the object.

Another objective of the present invention is to provide a back carrier frame which can hold an object in a specific angular position or a specific orientation, increasing use flexibility.

A further objective of the present invention is to provide a back carrier frame that can be folded when not in use, increasing convenience of carrying the back carrier frame.

The present invention fulfills the above objectives by providing a back carrier frame including a base. The base includes a body and a retaining device. The body includes a plurality of first pivotal portions. The retaining device is mounted to the body. A fixing seat includes an annular groove and a fixing portion. The retaining device is engaged in the annular groove to retain the fixing seat in place. The fixing portion extends out of the body. A support device includes at least three main supports. Each of the at least three main supports includes a second pivotal portion and a connection portion. The second pivotal portion of each of the at least three main supports is pivotably connected to one of the plurality of first pivotal portions. Two straps are provided. Each of the two straps has two ends respectively coupled to two of the connection portions of the at least three main supports.

The fixing portion of the fixing seat can include a supporting wall. The supporting wall is annular to define a positioning compartment.

The fixing seat can include an auxiliary fixing member mounted to the supporting wall.

The auxiliary fixing member can include a pressing end. The auxiliary fixing member slideably extends through the supporting wall to permit the pressing end to be movably received in the positioning compartment.

The supporting wall can include a first slot intercommunicated with the positioning compartment.

The supporting wall can further include a second slot intercommunicated with the positioning compartment.

The first slot can have a first limiting width, and the second slot can have a second limiting width smaller than the first limiting width.

The body can include a chamber receiving the retaining device. The retaining device extends through the body and is engaged in the annular groove in the chamber.

The retaining device can include an outer end outside of the body. The outer end of the retaining device has a coupling hole.

The support device can further include an auxiliary support having two first auxiliary pivotal portions. Each of the at least three main supports includes a second auxiliary pivotal portion. The two first auxiliary pivotal portions of the auxiliary support are pivotably connected to two first auxiliary pivotal portions respectively of two adjacent main supports.

The auxiliary support can include a folding portion located between the two first auxiliary pivotal portions.

The auxiliary support can further include an auxiliary strap.

Each of the at least three main supports can include an auxiliary engagement portion.

The auxiliary engagement portion can include a plurality of through-holes.

The at least four main supports can include four main supports.

The back carrier frame according to the present invention uses the fixing seat to retain the to-be-carried object in place, and the straps permits the user to carry the to-be-carried object on the user's back. Thus, the user does not have to hold the object by hands, increasing the convenience of carrying the object.

Furthermore, the fixing seat of the back carrier frame according to the present invention can rotate relative to the base, such that the fixing seat can fix the to-be-carried object in a specific angular position or a specific orientation, increasing use flexibility.

Furthermore, when the back carrier frame according to the present invention is not in use, the back carrier frame can be folded by the pivotal structures between the base and the support device, increasing the convenience of carrying the back carrier frame.

The present invention will become clearer in light of the following detailed description of illustrative embodiments of this invention described in connection with the drawings.

DETAILED DESCRIPTION OF THE INVENTION

Figure 1:
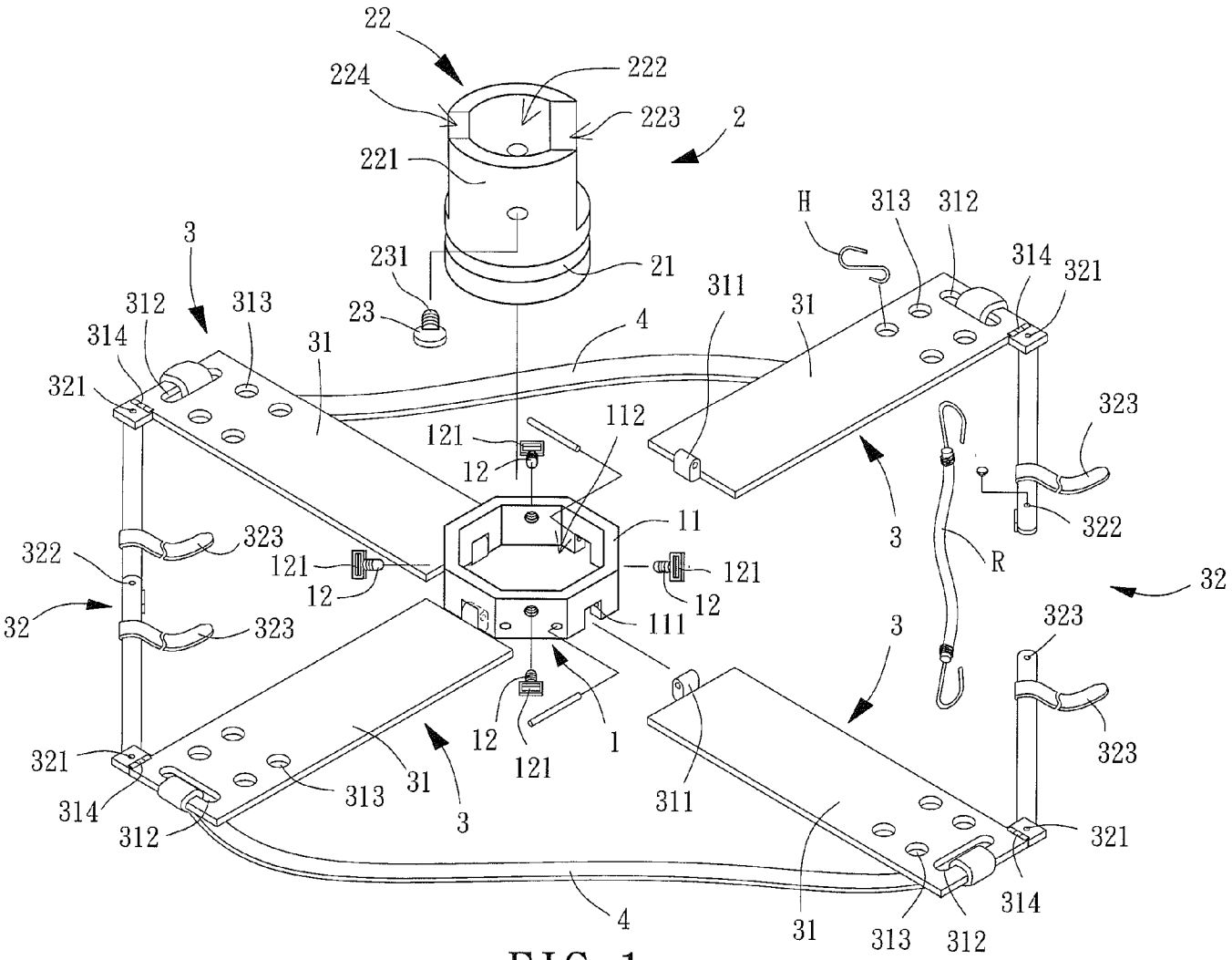
FIG. 1 is an exploded, perspective view of a back carrier frame according to the present invention.

With reference to FIGS. 1-4, a back carrier frame according to the present invention includes a base 1, a fixing seat 2, a support device 3, and two straps 4. The fixing seat 2 is mounted to the base 1. The support device 3 is pivotably mounted to the base 1. The two straps 4 are coupled to the support device 3.

The base 1 includes a body 11 and a retaining device 12. The retaining device 12 is mounted to the body 11. The body 11 includes a plurality of first pivotal portions 111.

The body 11 of the base 1 can be of any shape and any structure. The present invention is not limited in this regard. In this embodiment, the body 11 includes a tubular structure having an octagonal shape. The first pivotal portions 111 are provided on a peripheral wall of the body 11 and are spaced from each other in a circumferential direction around a longitudinal axis of the body 11. The tubular structure of the body 11 defines a chamber 112 for receiving the fixing seat 2.

The retaining device 12 can be integrally formed with the body 11 and is located on a side of the body 11 forming the chamber 112. The retaining device 12 retains the fixing seat 2 in the chamber 112. Alternatively, as shown in this embodiment, the retaining device 12 includes a plurality of screws. The retaining device 12 can extend through the body 11 to retain the fixing seat 2. The retaining device 12 includes an outer end outside of the body 11. The outer end of the retaining device 12 includes a coupling hole 121. Thus, the base 1 can retain the fixing seat 2 in the chamber 112 by the retaining device 12. A user can hook an object to the coupling hole 121 of the retaining device 12. Alternatively, a hook H or a fixing string R can be coupled with the coupling hole 121, such that the user can use the hook H or the fixing string R to fix the object, increasing the convenience of carrying the object.

With reference to FIGS. 1-4, in this embodiment, the fixing seat 2 is tubular and includes an annular groove 21 and a fixing portion 22. The annular groove 21 and the fixing portion 22 are located on two opposite ends of the fixing seat 2. The fixing seat 2 can be retained in place by the retaining device 12 engaged in the annular groove 21 to prevent the fixing seat 2 from moving along the longitudinal axis of the body 11. Furthermore, due to provision of the annular groove 21, the fixing seat 2 can rotate relative to the body 11 of the base 1 about the longitudinal axis of the body 11 to adjust the orientation of the fixing portion 22 of the fixing seat 2, such that the fixing portion 22 can retain the object in different angular positions or different orientations, providing use flexibility.

With reference to FIGS. 1-4, when the annular groove 21 of the fixing seat 2 is received in the chamber 112 of the body 11, the fixing portion 22 is located outside of the chamber 112 of the body 11. The fixing portion 22 of the fixing seat 2 includes a supporting wall 221. The supporting wall 221 is annular to define a positioning compartment 222. The positioning compartment 222 of the fixing portion 22 can be used to position the object, increasing the convenience of carrying the object.

With reference to FIGS. 1-4, the supporting wall 221 can include a first slot 223 and a second slot 224. The first slot 223 and the second slot 224 intercommunicate with the positioning compartment 222. The first slot 223 has a first limiting width G1. The second slot 224 has a second limiting width G2. The first limiting width G1 is larger than the second limiting width G2. Thus, in addition to using the positioning compartment 222 to fix the object, the fixing seat 2 can use the first slot 223 and the second slot 224 to restrain the object, increasing the convenience of carrying the object and increasing use flexibility.

Figure 2:
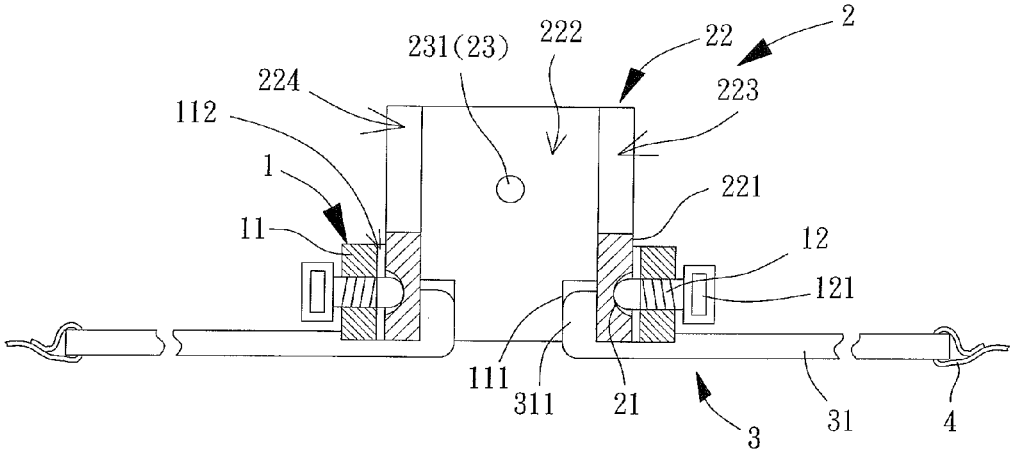
FIG. 2 is a partial, cross sectional view of the back carrier frame according to the present invention.
Figure 3:
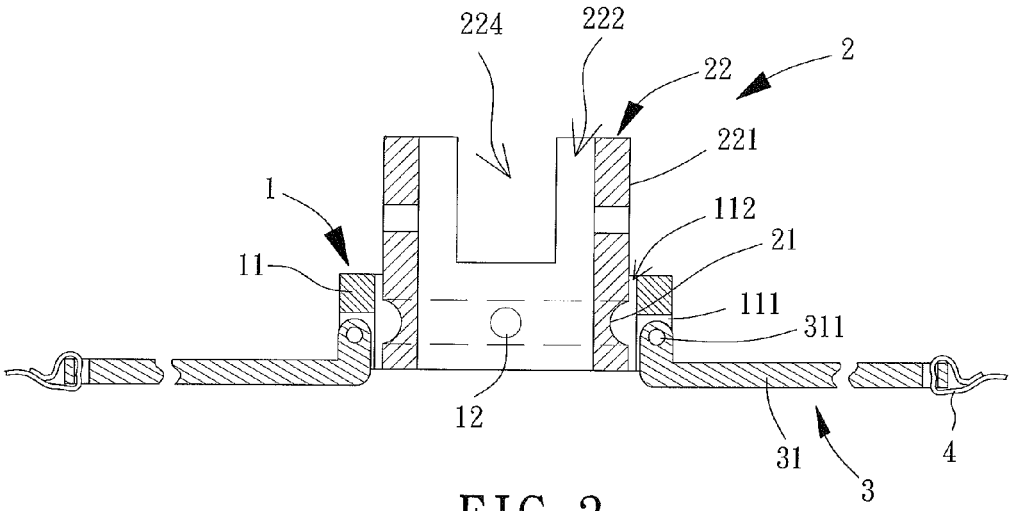
FIG. 3 is another partial, cross sectional view of the back carrier frame according to the present invention.
Figure 4:
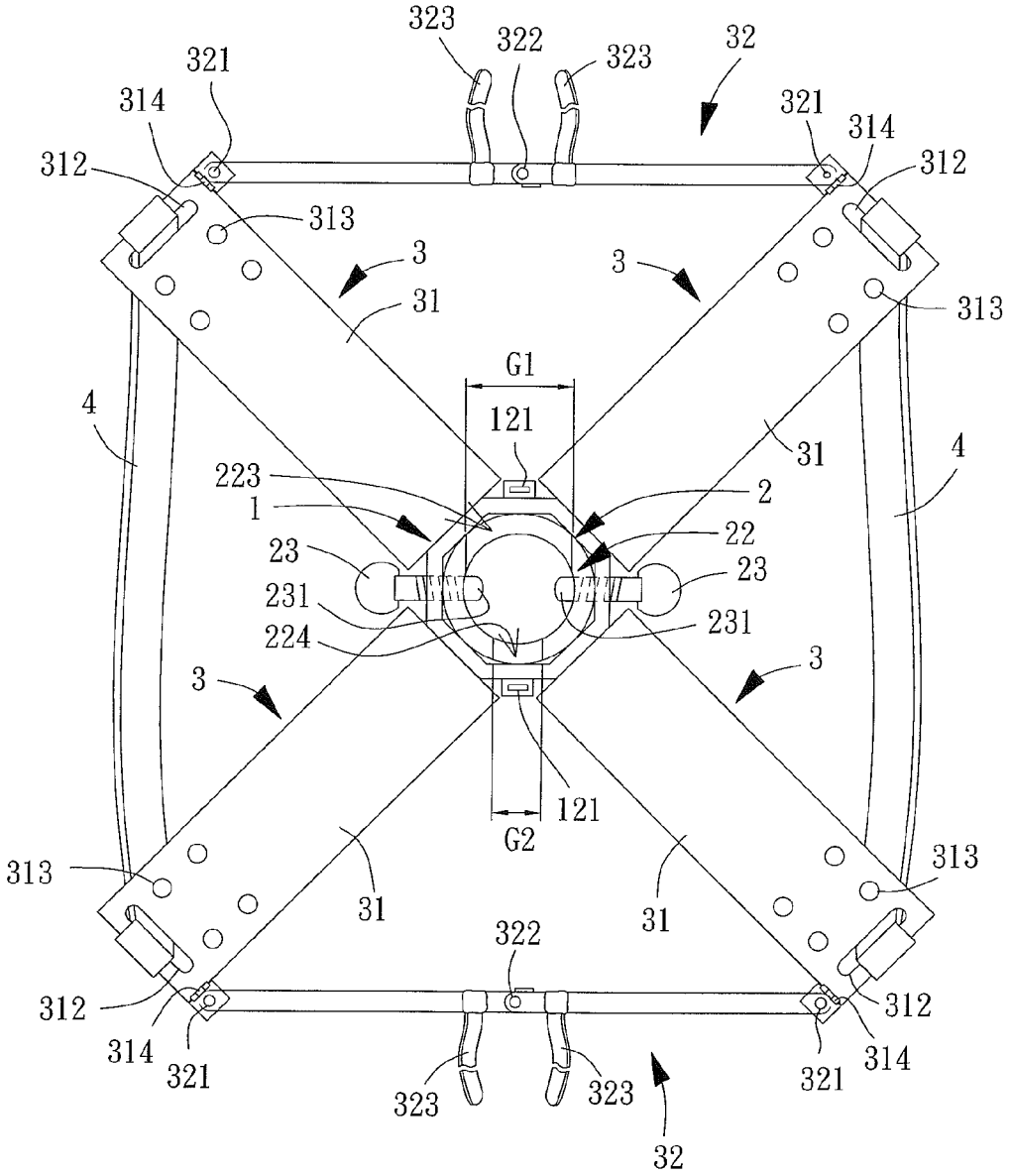
FIG. 4 is an elevational view of the back carrier frame according to the present invention in an unfolded state after assembly.

With reference to FIGS. 1, 2, and 4, the fixing seat 2 can include an auxiliary fixing member 23. The auxiliary fixing member 23 can be a bolt. Furthermore, the auxiliary fixing member 23 includes a pressing end 231. The auxiliary fixing member 23 slideably extends through the supporting wall 221 to permit the pressing end 231 to be movably received in the positioning compartment 222. Thus, the auxiliary fixing member 23 can press against the object in the positioning compartment 222 by the pressing end 231 to more reliably fix the object to the fixing seat 2, increasing the positioning stability of the object. In this embodiment, the fixing seat 2 includes two auxiliary fixing members 23.

With reference to FIGS. 1-4, the support device 3 includes a plurality of main supports 31. Each main support 31 includes a second pivotal portion 311 and a connection portion 312. The second pivotal portion 311 of each main support 31 is pivotably connected to one of the first pivotal portions 111 of the base 1. The support device 3 can include three or more main supports 31. The present invention is not limited in this regard. In a case that the support device 3 has three main supports 31, the three main supports 31 can be pivotably connected to the base 1 in a Y-shaped arrangement. In another case that the support device 3 has four main supports 31, the four main supports 31 can be pivotably connected to the base 1 in an X-shaped arrangement, as shown in this embodiment.

Each main support 31 can include an auxiliary engagement portion 313. The auxiliary engagement portion 313 can be of any provision. The present invention is not limited in this regard. In this embodiment, each auxiliary engagement portion 313 includes a plurality of through-holes for coupling with the hook H or the fixing string R. By the provision of the auxiliary engagement portions 313, the back carrier frame according to the present invention can be used to fix more objects. Alternatively, the object can be more securely positioned to a side of the main supports 31. The convenience of carrying the object is increased, and the positioning stability of the object is increased.

Still referring to FIGS. 1-4, the support device 3 can further include an auxiliary support 32 having two first auxiliary pivotal portions 321. Each main support 31 includes a second auxiliary pivotal portion 314. The two first auxiliary pivotal portions 321 of the auxiliary support 32 are pivotably connected to two first auxiliary pivotal portions 321 respectively of two adjacent main supports 31.

Specifically, the auxiliary support 32 includes a folding portion 322 located between the two first auxiliary pivotal portions 321. The auxiliary support 32 can be folded by the folding portion 322. The folding portion 322 can be a pivotal structure, as shown in this embodiment. Furthermore, the support device 3 can include more than one auxiliary support 32. The present invention is not limited in this regard. In this embodiment, the support device 3 includes two auxiliary supports 32 respectively on two sides of the base 1. By the provision of the auxiliary supports 32 and their pivotal structures, the auxiliary supports 32 and the main supports 31 can be unfolded and folded. Furthermore, the main supports 31 in the unfolded state are more stable, increasing the structural stability.

With reference to FIGS. 1 and 4, each auxiliary support 32 can further include an auxiliary strap 323. The auxiliary strap 323 can be a strap having hook and loop fasteners or providing a tying function. The present invention is not limited in this regard. By the provision of the auxiliary strap 323, the object can be more securely positioned on the fixing seat 2 and the support device 3, increasing the positioning stability of the object.

Still referring to FIGS. 1 and 4, two ends of each of the two straps 4 are respectively coupled to two of the connection portions 312 of the main supports 31. Each strap 4 can be in the form of a string and can assist the user in carrying the carrier back frame.

Figure 5:
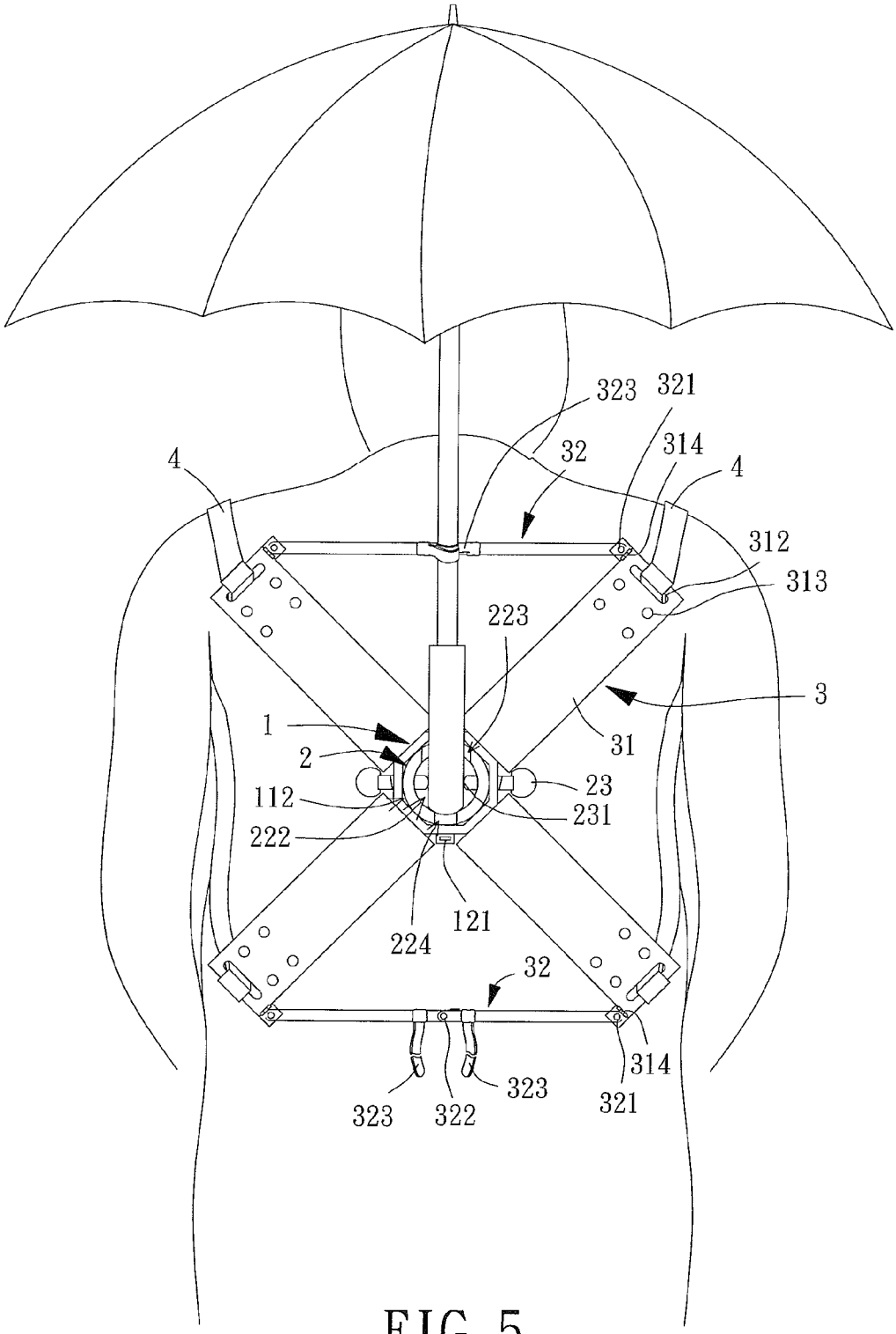
FIG. 5 is a perspective view illustrating use of the back carrier frame according to the present invention for holding an umbrella.
Figure 6:
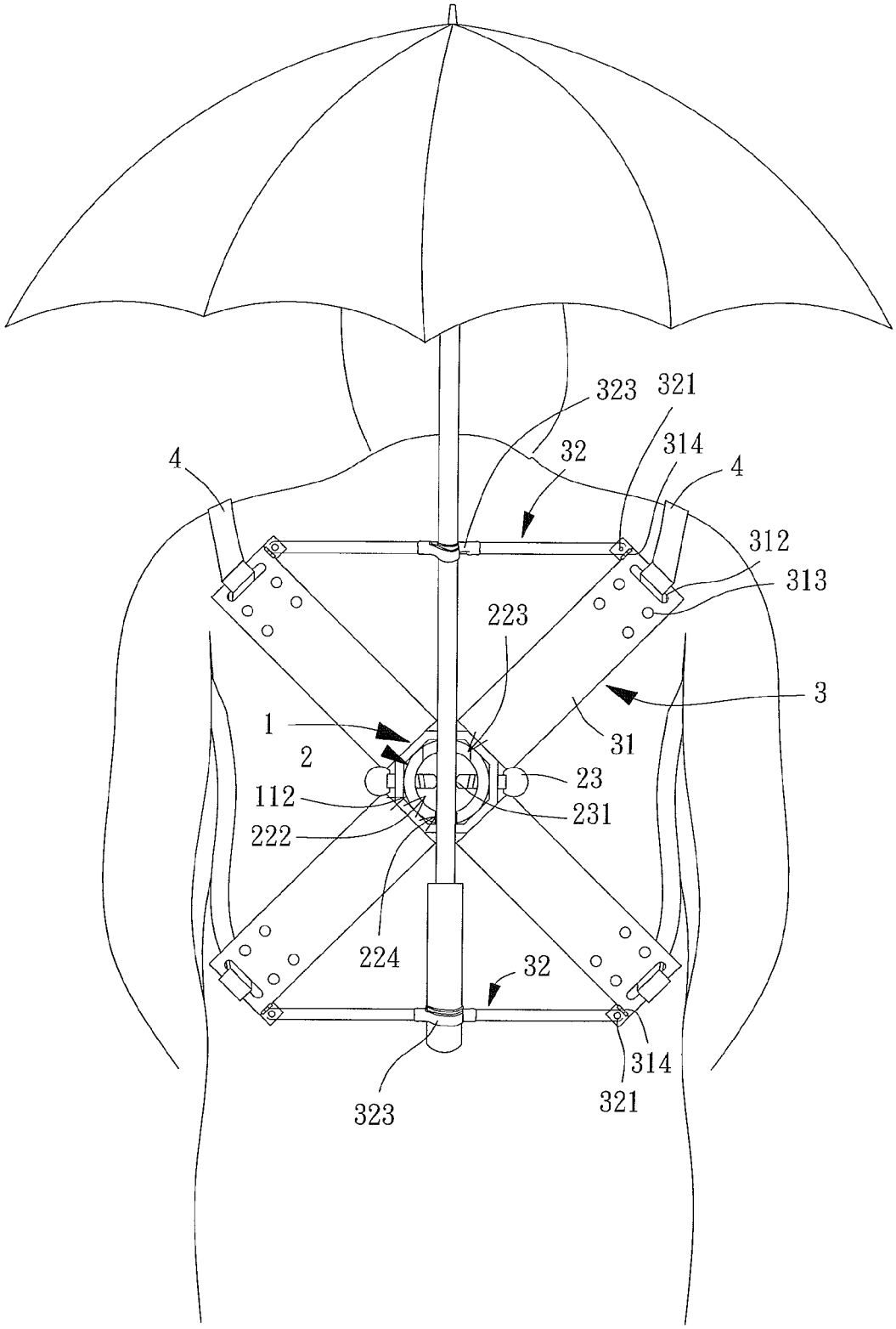
FIG. 6 is a perspective illustrating use of the back carrier frame according to the present invention for holding an umbrella with a longer shaft.

With reference to FIGS. 4-6, when the user intends to carry an umbrella by using the back carrier frame according to the present invention, the user can unfold the main supports 31, and a handle of the umbrella can be directly inserted into the positioning compartment 222 of the fixing portion 22. In a case that the diameter of the handle of the umbrella is smaller than the first limiting width G1 of the first slot 223, the handle of the umbrella can directly extend through the first slot 223 into the positioning compartment 222, as shown in this embodiment. In a case that the second limiting width G2 is smaller than the diameter of the handle of the umbrella or the supporting wall 221 does not include the second slot 224, the handle of the umbrella can be retained in the positioning compartment 222 by the restraining effect provide by the first slot 223.

With reference to FIG. 6, in a case that the umbrella has a longer shaft, if the diameter of the shaft of the umbrella is smaller than the first limiting width G1 and slightly larger than the second limiting width G2, the shaft of the umbrella can extend through the first slot 223 and the second slot 224, and the second slot 224 can retain the shaft of the umbrella in place by tight coupling, retaining the umbrella to the fixing seat 2. Then, the user can carry the umbrella on the user's back by using the straps 4 with the umbrella in an unfolded state without using the hands, increasing the convenience of carrying the object.

Furthermore, since the fixing seat 2 is rotatably retained to the body 11, the fixing seat 2 can be rotated in the clockwise direction or the counterclockwise direction to change the angular position or orientation of the first and second slots 223 and 224 for fixing the umbrella, increasing use flexibility.

Furthermore, in a case that the fixing seat 2 including the auxiliary fixing members 23, the auxiliary fixing members 23 can press against the handle or the shaft of the umbrella by the pressing ends 231 to more securely position the umbrella on the fixing seat 2, increasing the positioning stability of the object.

Furthermore, in a case that each auxiliary support 32 includes the auxiliary strap 323, the auxiliary straps 323 can be used to fix the shaft or the handle of the umbrella to more securely position the umbrella on the fixing seat 2 and the support device 3, increasing the positioning stability of the object.

Figure 7:
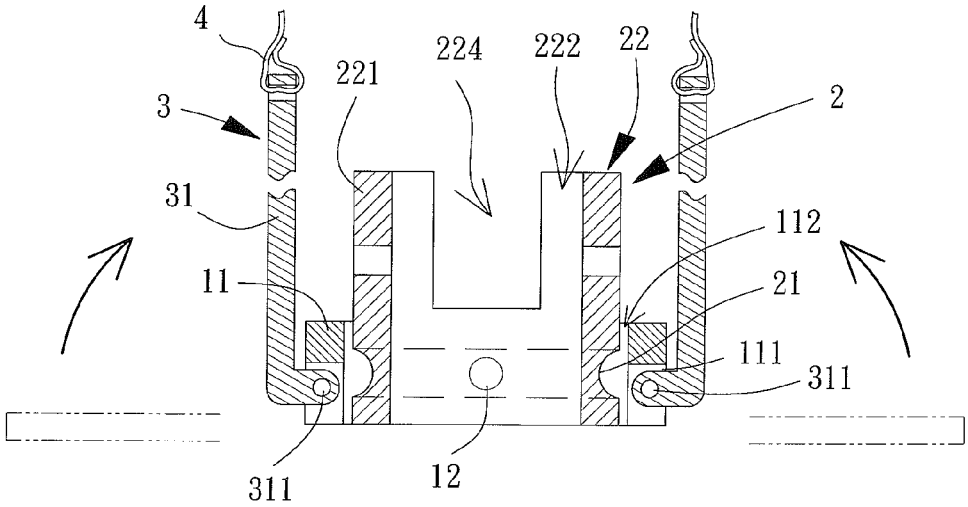
FIG. 7 is a partial, cross sectional view illustrating folding of the back carrier frame according to the present invention.
Figure 8:
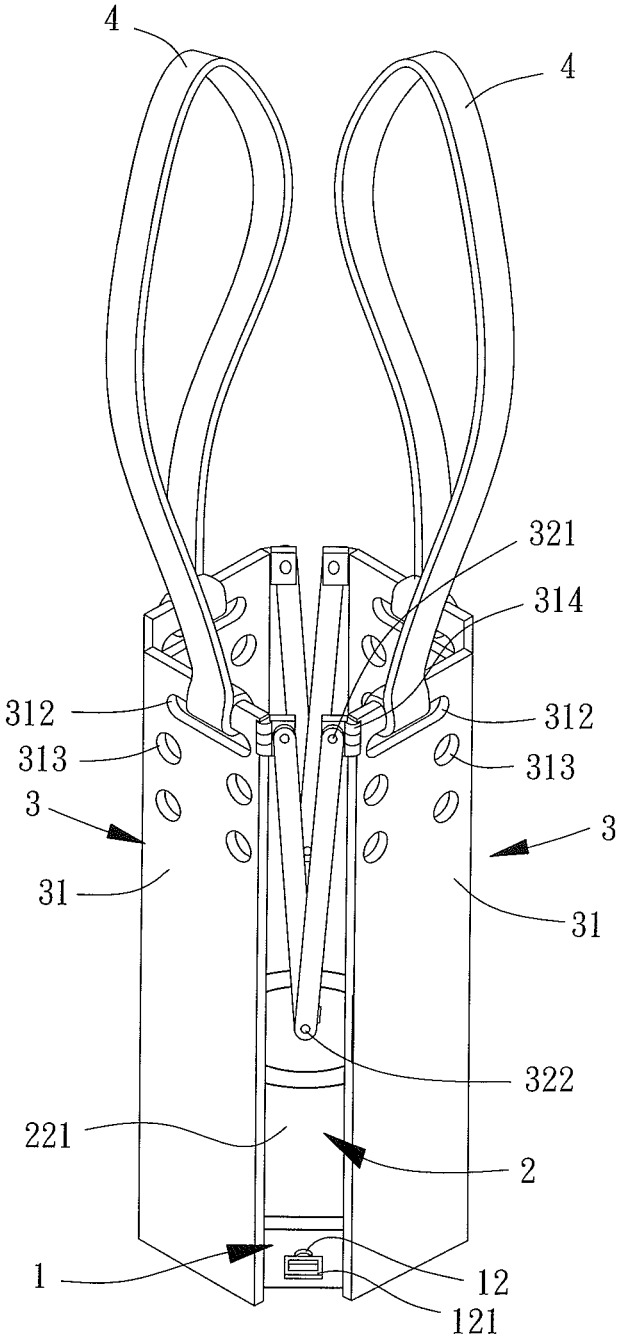
FIG. 8 is a perspective view of the back carrier frame according to the present invention in a folded state.

With reference to FIGS. 7 and 8, when the user intends to fold the support device 3, the main supports 31 are folded towards the base 1, and the auxiliary supports 32 are folded by the provision of the two first auxiliary pivotal portions 321 and the folding portions 322. Thus, the auxiliary supports 32 and the main supports 31 can be folded together to a folded state without occupying a large space. Then, the user can carry the back carrier frame according to the present invention by the straps 4, increasing the convenience of carrying the back carrier frame.

Figure 9:
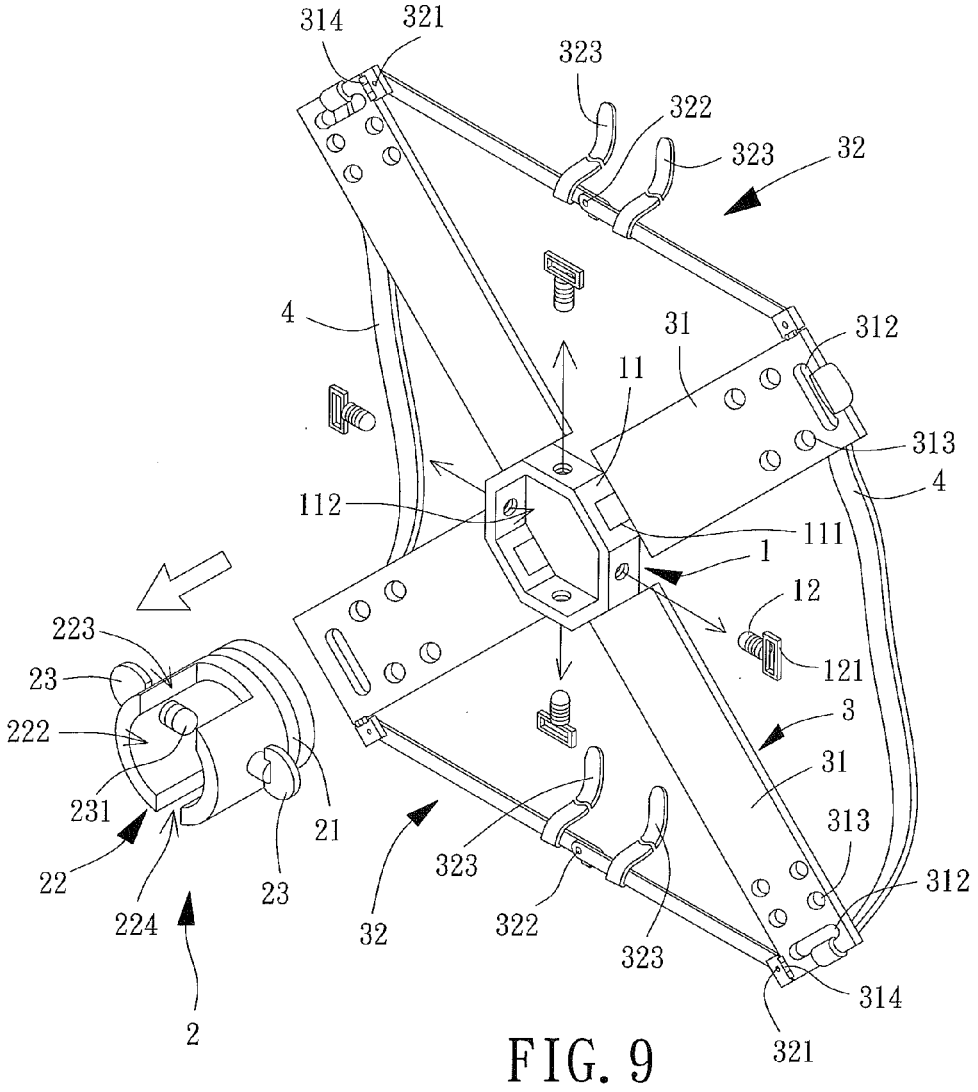
FIG. 9 is a perspective view illustrating another use of the back carrier frame according to the present invention.
Figure 10:
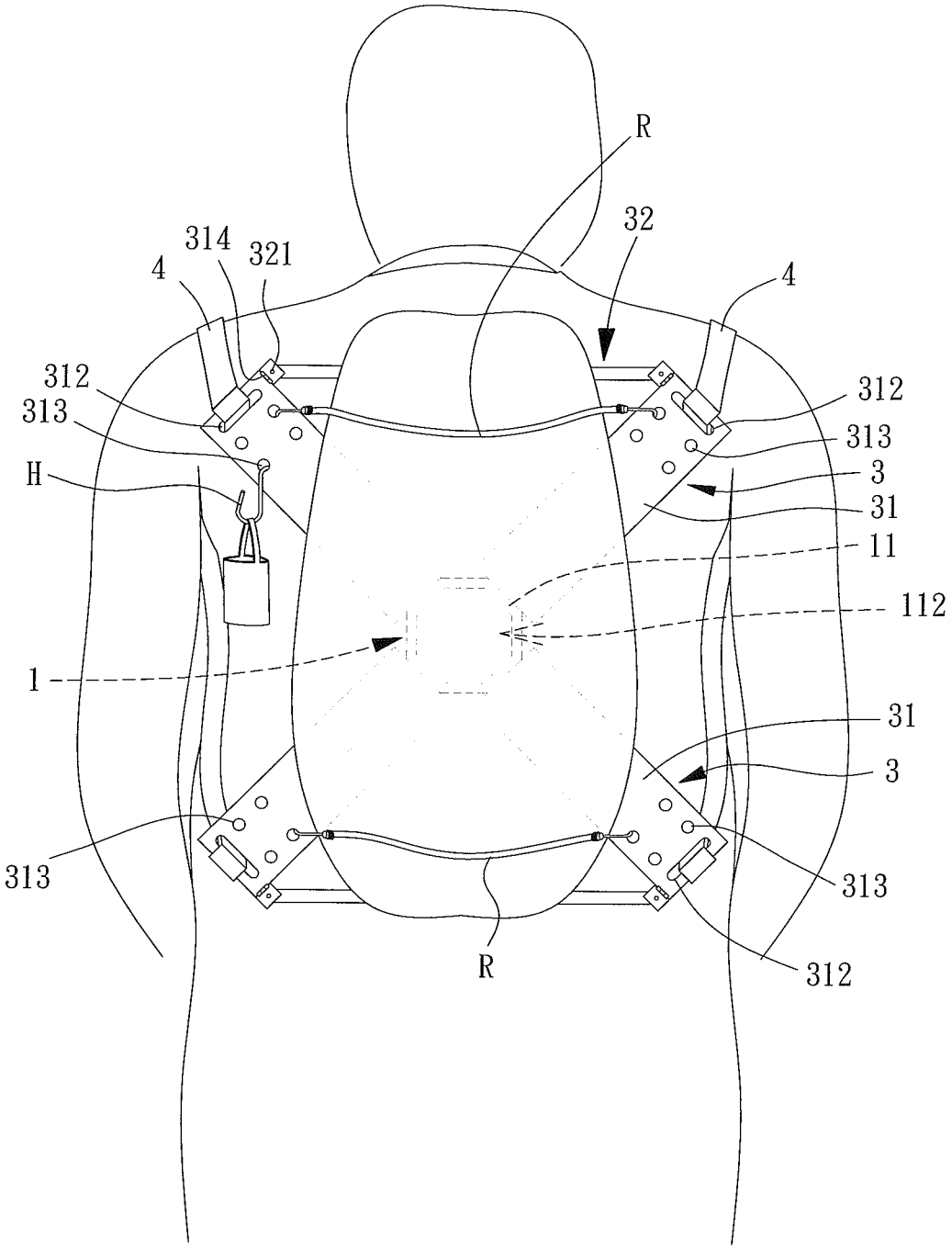
FIG. 10 is a perspective view illustrating use of the back carrier frame according to the present invention for holding a travel bag in a vertical direction.

With reference to FIGS. 9 and 10, when the user intends to fix a travel bag to the back carrier frame according to the present invention, the user can directly hook the travel bag to the fixing seat 2. Alternatively, the fixing seat 2 can be detached from the base 1, the travel bag is placed to a side of the support device 3, and two ends of each of two fixing strings R are respectively coupled with the auxiliary engagement portions 313 of two adjacent main supports 31. Thus, the travel bag can be securely positioned to the side of the support device 3 by the fixing strings R, and the user can carry the travel bag on the user's back by using the straps 4. Furthermore, other objects can be hooked to the auxiliary engagement portions 313 by using the hook H, permitting the user to carry a plurality of objects on the user's back and increasing the convenience of carrying the objects.

Figure 11:
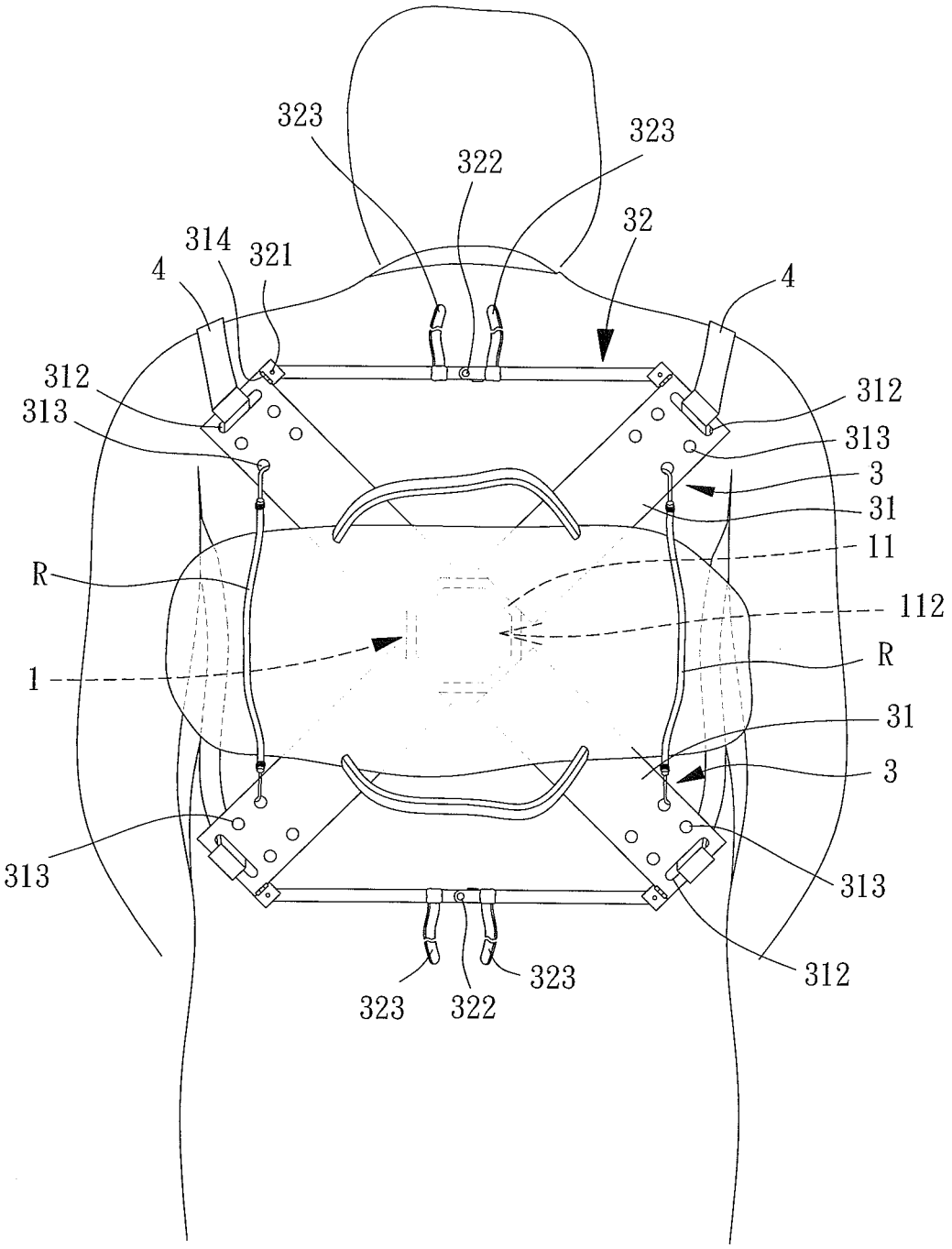
FIG. 11 is a perspective view illustrating use of the back carrier frame according to the present invention for holding a hand bag in a horizontal direction.

With reference to FIG. 11, when the user intends to fix a hand bag to the back carrier frame according to the present invention, the hand bag is firstly placed to a side of the support device 3, and two ends of each of two fixing strings R are respectively coupled with the auxiliary engagement portions 313 of two adjacent main supports 31. Thus, the hand bag can be reliably retained in place by the vertically disposed fixing strings R, permitting the user to carry the hand bag on the user's back by using the straps 4, thereby increasing the convenience of carrying the object.

In view of the foregoing, the back carrier frame according to the present invention uses the fixing seat 2 to retain the to-be-carried object in place, and the straps 4 permits the user to carry the to-be-carried object on the user's back. Thus, the user does not have to hold the object by hands, increasing the convenience of carrying the object.

Furthermore, the fixing seat 2 of the back carrier frame according to the present invention can rotate relative to the base 1, such that the fixing seat 2 can fix the to-be-carried object in a specific angular position or a specific orientation, increasing use flexibility.

Furthermore, when the back carrier frame according to the present invention is not in use, the back carrier frame can be folded by the pivotal structures between the base 1 and the support device 3, increasing the convenience of carrying the back carrier frame.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A back carrier frame comprising:

a base including a body and a retaining device, with the body including a plurality of first pivotal portions, and with the retaining device mounted to the body;

a fixing seat including an annular groove and a fixing portion, with the retaining device engaged in the annular groove to retain the fixing seat in place, and with the fixing portion extending out of the body;

a support device including at least three main supports, with each of the at least three main supports including a second pivotal portion and a connection portion, with the second pivotal portion of each of the at least three main supports pivotably connected to one of the plurality of first pivotal portions; and two straps, with each of the two straps having two ends respectively coupled to two of the connection portions of the at least three main supports.

2. The back carrier frame as claimed in claim 1, wherein the fixing portion of the fixing seat includes a supporting wall, and wherein the supporting wall is annular to define a positioning compartment.

3. The back carrier frame as claimed in claim 2, wherein the fixing seat includes an auxiliary fixing member mounted to the supporting wall.

4. The back carrier frame as claimed in claim 3, wherein the auxiliary fixing member includes a pressing end, and wherein the auxiliary fixing member slideably extends through the supporting wall to permit the pressing end to be movably received in the positioning compartment.

5. The back carrier frame as claimed in claim 2, wherein the supporting wall includes a first slot intercommunicated with the positioning compartment.

6. The back carrier frame as claimed in claim 5, wherein the supporting wall further includes a second slot intercommunicated with the positioning compartment.

7. The back carrier frame as claimed in claim 6, wherein the first slot has a first limiting width, and wherein the second slot has a second limiting width smaller than the first limiting width.

8. The back carrier frame as claimed in claim 1, wherein the body includes a chamber receiving the retaining device, and wherein the retaining device extends through the body and is engaged in the annular groove in the chamber.

9. The back carrier frame as claimed in claim 1, wherein the retaining device includes an outer end outside of the body, and wherein the outer end of the retaining device has a coupling hole.

10. The back carrier frame as claimed in claim 1, with the support device further including an auxiliary support having two first auxiliary pivotal portions, with each of the at least three main supports including a second auxiliary pivotal portion, and with the two first auxiliary pivotal portions of the auxiliary support pivotably connected to two second auxiliary pivotal portions respectively of two adjacent main supports.

11. The back carrier frame as claimed in claim 10, wherein the auxiliary support includes a folding portion located between the two first auxiliary pivotal portions.

12. The back carrier frame as claimed in claim 10, wherein the auxiliary support further includes an auxiliary strap.

13. The back carrier frame as claimed in claim 1, wherein each of the at least three main supports includes an auxiliary engagement portion.

14. The back carrier frame as claimed in claim 13, wherein the auxiliary engagement portion includes a plurality of through-holes.

15. The back carrier frame as claimed in claim 1, wherein the at least three main supports includes four main supports.

* * * * *